United States Patent [19]

Spiegelberg et al.

[11] 4,183,236

[45] Jan. 15, 1980

[54] METHOD OF ISOTHERMAL FORGING

[75] Inventors: William D. Spiegelberg, Parma; Donald J. Moracz, Garfield Heights, both of Ohio

[73] Assignee: TRW Inc., Clevelend, Ohio

[21] Appl. No.: 873,673

[22] Filed: Jan. 30, 1978

[51] Int. Cl.[2] ..... B21J 3/00

[52] U.S. Cl. ..... 72/42

[58] Field of Search ..... 72/41, 42, 46; 252/28, 252/29, 30

[56] References Cited

U.S. PATENT DOCUMENTS

| | | | |
|---|---|---|---|
| 2,112,632 | 3/1938 | Montgomery | 72/42 |
| 2,538,917 | 1/1951 | Sejournet et al. | 72/42 |
| 3,059,769 | 10/1962 | Frost | 72/42 |
| 3,110,399 | 11/1963 | Godron | 72/42 |
| 3,181,324 | 5/1965 | Labino | 72/42 |
| 3,295,346 | 1/1967 | Bomberger | 72/41 |
| 3,774,426 | 11/1973 | Jezik | 72/42 |
| 3,840,461 | 10/1974 | Espunes | 252/28 |
| 4,096,076 | 6/1978 | Spiegelberg | 72/42 X |

*Primary Examiner*—E. M. Combs

[57] ABSTRACT

A composition useful in isothermal forging or sizing of metal articles comprising a major amount of a glass moiety fusible at a temperature below forging or sizing temperature, and a minor amount of a finely divided abrasive moiety dispersed in the glass moiety and having a predetermined hardness.

16 Claims, 1 Drawing Figure

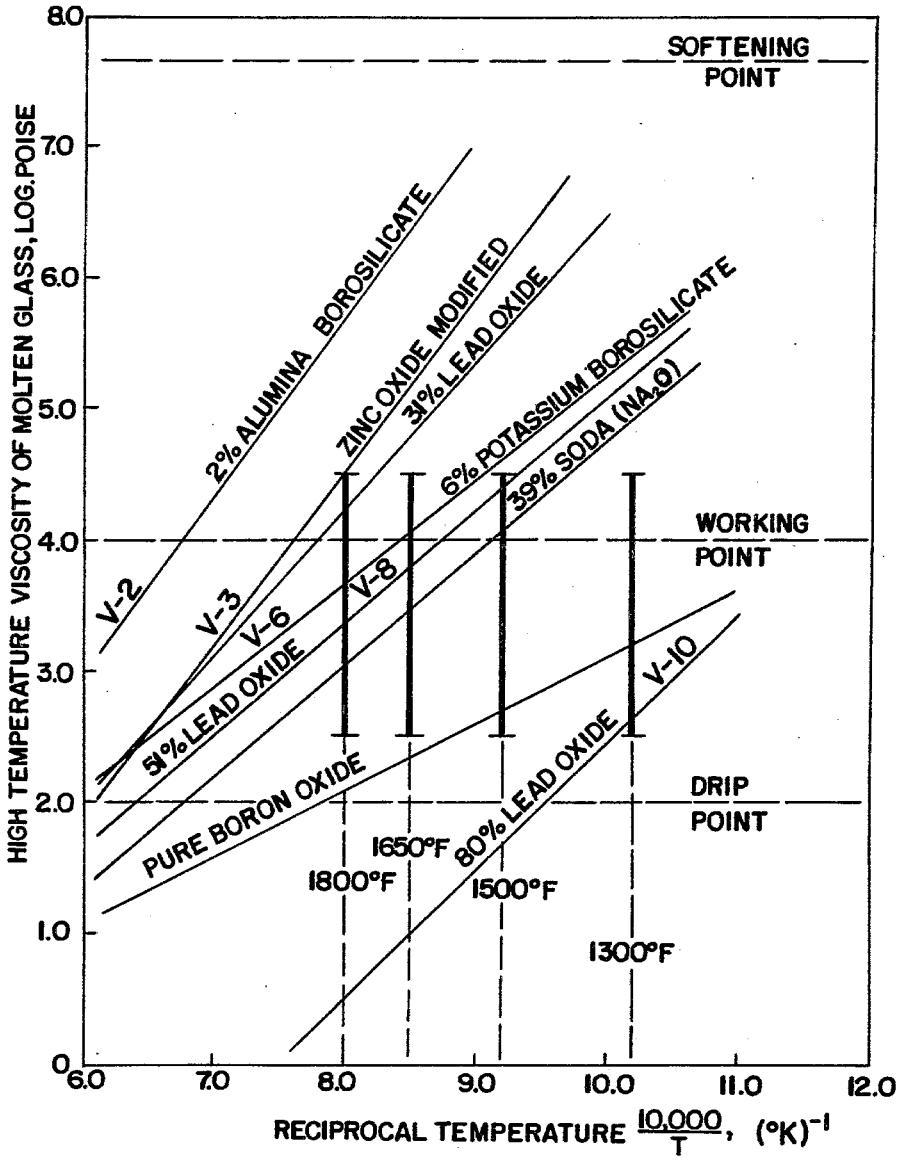
SOFTENING POINT
WORKING POINT
DRIP POINT
2% ALUMINA BOROSILICATE
ZINC OXIDE MODIFIED
31% LEAD OXIDE
6% POTASSIUM BOROSILICATE
39% SODA (NA2O)
51% LEAD OXIDE
PURE BORON OXIDE
80% LEAD OXIDE
V-2
V-3
V-6
V-8
V-10
1800°F
1650°F
1500°F
1300°F
HIGH TEMPERATURE VISCOSITY OF MOLTEN GLASS, LOG. POISE
RECIPROCAL TEMPERATURE 10,000/T, (°K)^-1
8.0
7.0
6.0
5.0
4.0
3.0
2.0
1.0
0
6.0
7.0
8.0
9.0
10.0
11.0
12.0

METHOD OF ISOTHERMAL FORGING

BACKGROUND OF THE INVENTION AND PRIOR ART

This invention relates to a lubricant composition for metal shaping and sizing operations, and more particularly to a dual purpose composition which is useful as a lubricant in isothermal forging and sizing procedures, and also useful as a separation composition after the shaping or sizing operation is complete to aid in removal of the workpiece from the die. These compositions function at the interface between a metallic die and a workpiece. These compositions have specific applicability to the isothermal forging and isothermal sizing of refractory metals, e.g., titanium, in dies made of the so-called superalloy materials which contain substantial amounts of nickel and chromium.

Hot shaping of metal is not new, neither are lubricant compositions for use therein. An important work in this field is the patent to Dolch No. 3,154,849 which describes the precoat lubrication of the interface between the die and a metal (Titanium) workpiece with a vitreous composition characterized by the presence therein of silica and lead oxide. The Dolch disclosure relates to impact forging. The lubricant there disclosed is applied as a slurry by spray gun application to the workpiece. An organic precoat medium composed of a solvent and/or a diluent and a resinous vehicle was used to assist application of the lubricant to the workpiece. As the temperature of the workpiece was raised to forging temperature, the organic solvent, e.g. alcohol, evaporated and the resinous portion which served as a temporary binder was ultimately thermally decomposed. One of the problems with lubricants of this type when utilized in isothermal forging or sizing has been glass buildup in the dies. The accretion of glass had to be chipped out after relatively few times of use.

In isothermal forging, both the die and the workpiece are elevated to a forging temperature and rather than impact shaping, a slow, steady high pressure is applied by hydraulic means. Isothermal "sizing" as opposed to isothermal forging refers to a relatively light reduction taken in the workpiece to bring a forged workpiece to final net dimensions and surface finish. Ease of release or separation from the die is vital and accumulation of material from the lubricant or separation compound is not tolerable for an isothermal forging or sizing operation.

Initial forging lubricants in this field were composed of graphite suspended in water. Application of the lubricant was difficult because the water vehicle was lost before the graphite was on the surface of the hot workpiece or the die. In order to raise the vapor pressure, there was then substituted for the water a glycol material. While this aided in deposition of the graphite on the surface, copious quantities of smoke were produced which caused a problem in the shop.

It was later discovered that sodium silicate provided a suitable vehicle for graphite, and compositions so produced worked quite well. There was found, however, in certain applications a tendency for the surface of the finished workpiece to show lubricant streaks. To alleviate this problem, the graphite was then suspended in an organic medium including a silicon binder and a solvent which gave better results. However, the surface of the resulting workpiece was still not satisfactory.

These coatings did not, however, stick to the dies and consequently cleanup of the dies was greatly facilitated.

Where considerable metal movement was contemplated, graphite was found to be difficult to work with because the die loading had to be so high for substantial metal movement that damage to the die itself was encountered. It was found that by increasing the vitreous or glass component, die life was improved and greater metal movement could be achieved. Increasing the glass component in these systems appeared satisfactory up to about 50% glass content. At higher concentrations of glass with a solid lubricant dispersed therein there was loss in surface integrity which necessitated a machining operation to produce the proper surface on the articles.

Various other lubricant compositions have been tried some with considerable success such as shown in Ser. No. 653,382 filed Jan. 29, 1976, now U.S. Pat. No. 4,096,076 to Spiegelberg. This composition depends upon boron nitride as a solid lubricant in a boron trioxide containing vitreous phase.

In summary, the prior art in providing a lubricating composition for hot forging techniques has proceeded with the concept a relatively soft dry lubricant, e.g. graphite/or boron nitride, suspended in a fused glass-like vehicle. Problems have been encountered in isothermal hot forging techniques with effectiveness of the lubricant, pressure required to move considerable amounts of metal, buildup of lubricant in the die, surface characteristics, etc. Moreover, prior art compositions have been found to have a narrow thermal spectrum, e.g. about 150° F. over which they are useful.

The present invention represents a sharp departure from these earlier concepts. Instead of using a soft dry lubricant, it has been found that a finely divided hard abrasive material suspended in a glass or fused vitreous medium provides not only excellent "lubrication" but also good separation of the workpiece from the die. Large amounts of metal may be moved easily. In sizing operations, they are effective in providing a finished surface requiring little or no further machining. These compositions may be formulated to be useful over a thermal spectrum of several hundred degrees F. in accordance with the teachings hereof. Still further, there is no buildup of glass in the die, lower temperatures can be used for the forging operation, and die life is improved. The compositions are easy to apply, stable at preheat temperature, have long shelf life, environmental inertness and moderate cost.

SUMMARY OF THE INVENTION

Briefly stated, the present invention is in an isothermal forging separation and lubricating composition for shaping a metal workpiece in a hot die. The lubricant comprises a major amount of vitreous component and a minor amount of a finely divided inorganic compound having a melting point above about 2,000° F. and a hardness at room temperature of at least 5.5 Mohs. The vitreous component is one which fuses at a temperature below the temperature of the hot die during the forging operation and above 500° F. The inorganic abrasive compound has a melting point above the temperature of the die during forging, and preferably above about 2000° F. As indicated, the inorganic compound is finely divided and has a particle size in the range of from 1–75 microns, preferrably 5–50 microns. 75 microns is equivalent to −200 mesh (U.S. Tyler). The inorganic, abrasive compound is nonreactive with the metal of the workpiece and the metal of the die at forging temperatures. The preferred compositions hereof are especially useful in the isothermal forging of beta titanium alloys in a temperature range of 1300° to 1500° F. to form aircraft structural components, e.g. braces, hinges, etc.

BRIEF DESCRIPTION OF THE DRAWING

The annexed drawing is a graph showing the logarithm of the viscosity of molten glass vehicle vs. reciprocal temperature for selected glass forming compositions.

DETAILED DESCRIPTION OF THE INVENTION AND SPECIFIC EXAMPLES

As indicated above, the lubrication and separation compositions of the present invention are characterized by two principal ingredients; namely, a vitreous component and at least one finely divided relatively hard inorganic material which is solid at temperatures substantially higher than forging temperatures.

THE VITREOUS MATERIAL

Broadly speaking, the vitreous material comprising the vitreous component of the present invention must be a liquid at forging temperatures. For most purposes, forging temperatures as contemplated by the present invention are in the range from about 1200° F. to about 2000° F. Thus, the vitreous component must be a liquid at whatever temperature within the foregoing range is utilized to effect forging. Normally, the vitreous material is a solid at ordinary temperatures and remains so to temperatures in excess of 500° F. Accordingly, the vitreous component is one which fuses at a temperature below the temperature of the hot die during forging and above 500° F.

Chemically, the vitreous materials are generally a mixture of metal oxides, a primary example thereof being silicon dioxide, $SiO_2$. While some simple oxide materials such as silicon dioxide, boron trioxide, and the like may be used, most frequently, the metal oxides are complex metal oxides or mixtures of metal oxides. Typical examples of vitreous materials which may be used in accordance with this invention include 2% alumina borosilicate glass, zinc oxide modified glass, 31% lead oxide-silicate, 51% lead oxide silicate, 80% lead oxide-silicate, boron trioxide, 6% potassium borosilicate, 39% sodium oxide-silicate, etc. The number of metal oxide complexes and compositions which may be used in accordance with the present invention are innumerable, and it has been found at the most useful way of describing the limits of useful materials is by means of a "forging window".

Reference may be had to the annexed drawings of which illustrates the "forging window" concept which is particularly applicable to the isothermal forging of titanium or titanium alloys, particularly beta titanium alloys, in dies formed of nickel and chromium-containing "super alloys". The latter alloys are well known to those skilled in the art and form no part of the present invention other than the fact that the lubricating and separating compositions of the present invention are particularly useful therewith.

For most purposes, the logarithm of the viscosity of the molten vitreous components measured in poises for hot or isothermal forging procedures should be between the drip point of 2 and the most convenient working point which is about four. The desired range of working viscosities is from about 2.5 to 4.5. In FIG. 1, the best temperature range expressed in terms of reciprocal temperature is between approximately 10.2 and 8.0. This corresponds to forging temperatures of about 1300° F. to 1800° F., which temperature range has been found particularly satisfactory for the isothermal forging and sizing of titanium and titanium alloy workpieces in super alloy dies. Thus, the "forging window" is defined in the graph shown in FIG. 1 between the viscosity limits of a minimum of about 2.5 to a maximum of about 4.5 expressed as the logarithm of the viscosity in terms of poises and between the operating temperatures of 1300° and 1800° F.

The term "reciprocal temperature" is one of convenience so that the resultant curves for the various vitreous materials will appear as nearly straight lines. "Reciprocal temperature" is defined as 10,000 divided by the absolute temperature of forging expressed in degrees Kelvin. Thus, the "forging window" is a rectangular zone located between the drip point viscosity and a working viscosity less than the softening point viscosity. Any glass composition falling within that zone for the particular forging operation to be performed, and giving due consideration to reactivity with the workpiece, contamination of the workpiece or dies, reactivity with the die materials, and the like, may be used. Each forging system (i.e., die material and workpiece material) has its own "forging window" which, for the most part, will vary laterally on the chart of FIG. 1 with the temperature of the forging operation.

As a typical example, pure boron oxide is an acceptable vitreous material for use as the vitreous phase of the lubricant and separation compositions of the present invention. For the entire temperature range of 1300° to 1600° F., boron trioxide shows a viscosity curve which is wholly within the"forging window". A 2% alumina borosilicate glass is outside of the "forging window" for titanium alloy metal being worked in nickel-chromium super alloy dies. It may, however, be within the "forging window" for use in dies or with metals where higher temperatures of forging can be utilized. In like manner, 80% lead oxide-silicate glass appears to be quite satisfactory at the lower temperatures of forging, and may for example, be used in the isothermal forging of titanium at temperatures of 1300° F. A 2% alumina borosilicate glass composition which is outside the "forging window" for titanium or titanium alloy workpieces in nickel-chromium containing super alloy dies, can be used in another system using different dies and a different workpiece material.

The vertical black bars in the annexed drawings are illustrative of desired work ranges within the "forging window" at the indicated temperatures wherein the glasses utilized have the properties which render them useful. If the viscosity curve crosses the black line at the predetermined forging temperature, the glass may be used. Secondary considerations involve, of course, reactivity of the glass with the workpiece and/or dies, contamination of the workpiece, and/or dies. Sulphur or arsenic containing vitreous materials and those containing appreciable precentages of alkali metal oxides are generally avoided in titanium metal forging for contamination reasons.

The dotted line across the top of the graph is indicative of the viscosity at the softening point of the glass. The preferred working point is shown by a horizontal dotted line is at a viscosity value of approximately 4.0. Satisfactory results are obtained in general in the range of from about 2.0 to about 4.5, the preferred range being from about 2.8 to 4.2.

The following table sets forth illustrative examples of vitreous compositions suitable for use in accordance herewith. For most purposes, the vitreous materials contain substantial amounts, i.e., 30% to 70% by weight of the glass, of silica, boron oxide, or a mixture of silicon and boron oxides.

TABLE I

COMPOSITION OF VITREOUS MATERIALS IN % BY WEIGHT

| Metal Oxides | Example Numbers | | | | | | | | | | | | |
|---|---|---|---|---|---|---|---|---|---|---|---|---|---|
| | V-1 | V-2 | V-3 | V-4 | V-5 | V-6 | V-7 | V-8 | V-9 | V-10 | V-11 | V-12 | V-13 |
| $SiO_2$ | 72.5 | 81 | 71 | 48.2 | 56 | 66.4 | 65.6 | 41.2 | 71.7 | 20.3 | 31.0 | 42.0 | 62 |
| $Al_2O_3$ | 1.3 | 2 | 1 | 1.5 | 2 | | | | | | | | 10 |
| $B_2O_3$ | | 13 | 12 | 4.9 | | 13.0 | | | 5.0 | | 60.0 | | 1 |
| $Na_2O$ | 15.9 | 4 | 5 | 0.9 | 4 | | 13.2 | 0.7 | 14.7 | | | 2.0 | 7 |
| $K_2O$ | 0.5 | | | 7.0 | 9 | 6.2 | 5.6 | 6.5 | 5.2 | 0.4 | 7.0 | 6.0 | 1 |
| MgO | 3.3 | | | | | | | | | | | | |
| CaO | 6.5 | | | | | | | | 2.2 | | | | 4 |
| PbO | | | | | 29 | 14.4 | 10.0 | 51.1 | | 79.3 | | 49.0 | 3 |
| BaO | | | | 30.0 | | | 0.2 | | | | | | |
| ZnO | | | 11 | 7.5 | | | 3.6 | | | | | | 12 |
| $Li_2O$ | | | | | | | | | | | | 1.0 | |
| CoO | | | | | | | | | | | 2.0 | | |
| $Sb_2O_3$ | | | | | | | 1.8 | | 1.2 | | | | |
| $As_2O_3$ | | | | | | | | 0.5 | | | | | |

At high forging temperatures, e.g., 1800° F. the alkali metal oxides tend to be corrosive to superalloy die materials and hence the alkali metal oxide content is desirably limited to less than 5% and preferably below 2%, e.g., a few ppm. At the lower forging temperatures, e.g., 1250°–1350° F. for such dies, alkali metal fluxing materials may desirably be present.

The metal oxide or mixture of metal oxides from which the vitreous component is made, are used as finely divided materials. The average particle size of the vitreous material should be within the broad range of 1 to 100 microns, and preferably from 2 to 40 microns. A convenient screen size is −325 mesh.

THE ABRASIVE MATERIAL

Broadly speaking, the abrasive materials useful in accordance with the present invention are natural or synthetic materials which are relatively quite hard. They range from diamond on one end of the scale to titanium dioxide on the lower end of the hardness scale. At room temperature, the hardness range expressed in terms of Mohs is 5.5 to 10.00, diamond at 10 being the hardest. These materials are infusible or have softening points which are substantially in excess of the forging temperature, for example, above about 2000° F.

As indicated above, the particle size of the abrasive material is quite important and for best results should be in the range of from about 1 to about 75 microns, preferably 5–50 microns average particle size.

Chemically, the abrasive materials may be oxides, nitrides or carbides of various metals. For example, silicon carbide, titanium carbide, tantalum carbide, chromium carbide, nickel carbide, titanium selenide, titanium nitride, or cubic boron nitride may be used. These materials are not normally naturally occurring. They have hardnesses in the range of 5.5 to 10 Mohs. Materials which do not occur in nature and which may be used in accordance herewith are various minerals such as zirconium oxide, beryllium oxide, etc.

Reference may be had to any table of minerals such as that in Lange's Handbook of Chemistry Tenth Edition, 1961, pages 150 to 200 for further examples of materials which may be used in accordance with the present invention.

In selecting an abrasive material for use in accordance herewith, consideration should be given to the environment in which the material will be used. In isothermal forging, the heat conditions are frequently at incandescent temperatures, for example, in the range of from 1300° to 1800° F. If the ambient tmosphere is air, the use of diamond although the ultimate in hardness would be contra-indicated because of its ease of oxidation to carbon dioxide under the conditions. In an inert atmosphere, e.g., an argon atmosphere, finely divided diamond dust may be used. Also, the abrasive material should be infusible and stable at forging temperatures, and preferably infusible according to Penfield's scale of fusibility.

Blends of two or more abrasive materials may also be used if desired.

Specific examples of infusible mineral abrasive materials with the hardness at room temperature in Mohs indicated are as follows:

TABLE II

| | |
|---|---|
| Amethyst | 7 |
| Titanium dioxide (Anatase) | 5.6–6 |
| Andalusite ($Al_2O_3 \cdot SiO_2$) | 7.5 |
| Zirconium oxide silicate ($ZrSiO_x$) | 6 |
| Barylite ($Be_2BaSi_2O_7$) | 6–7 |
| Bertrandite ($4BeO \cdot 2SiO_2 \cdot H_2O$) | 6.7 |
| Cassiterite ($SnO_2$) | 6–7 |
| $BeO\ Al_2O_3$ | 8.5 |
| $Mg_2Al_4Si_5O_{18}$ | 7–7.5 |
| Diamond (C) | 10 |
| $BaAl_2Si_2O_8$ | 6–6.5 |
| $KAlSi_3O_8$ | 6 |
| $2MgO \cdot SiO_2$ | 6–7 |
| $ZnAl_2O_4$ | 7.5–8 |
| $Be_3(Al_1, Fe)_2(SiO_2)_3$ | 7.5–8 |
| Hematite ($Fe_2O_3$) | 5.5–6.5 |
| $FeO \cdot Al_2O_3$ | 7.5–8 |
| Kyanite ($Al_2O_3 \cdot SiO_2$) | 5.7 |
| $KAl(SiO_3)_2$ | 5.5–6 |
| $MnO \cdot Ta_2O_5$ | 6–6.5 |
| SiC | 9.5 |
| $2(Mg, Fe)O \cdot SiO_2$ | 6–7 |
| Opal ($SiO_2 \cdot nH_2O$) | 5.5–6.5 |
| MgO | 5.5–6 |
| $CaTiO_3$ | 5.5 |
| $2BeO \cdot SiO_2$ | 7.5–8 |
| $Fe_2TiO_5$ | 6 |
| Quartz | 7 |
| $5MgO \cdot 6\ Al_2O_3 \cdot 2SiO_2$ | 7.5 |
| Sillimanite | 6–7 |
| $2FeO \cdot 5Al_2O_3$ | 7–7.5 |
| Spinel $MgO \cdot Al_2O_3$ | 8 |
| $Fe\ (Ta, Nb)_2Ti_6O_{18}$ | 6 |
| $(Fe, Mn)\ (Nb, Ta)_2O_6$ | 8 |

TABLE II-continued

| | |
|---|---|
| Topaz | 8 |
| $ZrO_2 \cdot SiO_2$ (Zircon) | 7.5 |

The foregoing materials are all rated as "infusible" according to Penfield's scale of fusibility with a blow pipe.

TABLE III

| Synthetic or Purified Abrasive Particles | | | |
|---|---|---|---|
| Example | Material | Composition | Average Particle Size |
| A-1 | Titanium Nitride | TiN(20.6% $N_2$) | −200 mesh |
| A-2 | Titanium Carbide | TiC | 3-6 micron |
| A-3 | Tantalum Carbide | TaC | −200 mesh |
| A-4 | Tungsten Carbide | WC | 5-10 micron |
| A-5 | Chromium Carbide | $Cr_3C_2$ | 6-8 micron |
| A-6 | Silicon Carbide | SiC | 6-8 micron |
| A-7 | Aluminum Oxide | $Al_2O_3$ | 5-10 micron |

PRECOAT COMPONENTS

The previous essential components of the compositions of the present invention are those which exist under forging conditions. In order to apply the compositions of the present invention to the workpiece prior to forging, it has been found convenient to suspend the glass and the abrasive material in an organic medium which enables the lubricating composition to be applied by an convenient method such as brushing, spraying, dipping, or the like. The chemical nature of the organic materials is unimportant so long as they produce a suitable system in which to apply the forging lubricant to the workpiece surface. The precoat ingredients include, therefore, an organic solvent and/or diluent and a resinous material. The solvent is removed from the workpiece by evaporation during a preliminary preheat cycle, and the resinous material or binder is removed by thermal decomposition during the final preheat cycle. The resinous binder material is preferably a noncharring resin at decomposition temperatures and one that has good "green strength" after low temperature preheating of the coated workpiece at 150° to 250° F., e.g., 180°-200° F.

The solvent component will be determined in large measure by the nature of the resinous binder material and the amount by the selected mode of application. Any volatile solvent or solvent/diluent composition may be used so long as it dissolves or extends the resinous material. For example, if the resinous binder material is a polymethylmethacrylate, a suitable solvent is methyl acrylate monomer or isopropylalcohol or xylene. If the organic resinous binder material is an acrylonitrile derivative, acrylonitrile monomer may be used as the solvent. If polystyrene is the binder material, monomeric styrene may be used as the solvent. Numerous other resinous materials are thus available for use and suitable solvents and diluents therefore are well known to those skilled in the art. Inasmuch as the solvent and/or diluent is nonreactive with any of the other components of the lubricants of this invention, its chemical and physical nature is of importance only with respect to the resin used as a binder. It disappears from the composition during the preheating of the coated workpiece to near the forging temperature. Aromatic solvents such as xylene, toluene, benzene may be used; alcohols such as isopropyl alcohol, methyl alcohol, and the like may be used; ethers, such as butyl cellosolve may be used; hydrocarbon diluents such as mineral spirits, cyclohexane, etc. may be used. Organic resinous materials in addition to those mentioned above which may be used include polyethylene, polypropylene, polyvinylchloride, silicone resins, epoxy resins, alkyd resins, oil modified alkyd resins, and the like.

In formulating the compositions of the present invention, the glass and the abrasive material are present as inorganic particulate materials. As they are insoluble in the system, they must be dispersed in the organic medium in an amount sufficient to yield a sprayable, brushable, or liquid bath composition for dipping or immersion of the workpiece. Formulation of the compositions to any of these modes of application is well known to those skilled in the art, and will be readily apparent from the specific examples which follow.

The lubricant composition itself remains after evaporation of the solvent and thermal decomposition of the binder material, and is composed of the glass component or moiety in a major amount, i.e., above 50%, and preferably above about 80% with the abrasive material constituting the balance. Minor amounts of other materials may be present, but such ingredients have not been found to be necessary. For example, under certain circumstances graphite may be included in the composition. Alternatively, boron nitride and graphite may be included as additives alone or in admixture.

It should also be understood that the following specific examples are primarily useful in the field of isothermal forging of titanium or titanium alloys in super alloy dies. These are for illustrative purposes only and it is to be understood that the principles of the present invention may be applied to the forging of other metals in other dies under other conditions. Those skilled in the art will be enabled by the present disclosure to formulate numerous additional examples of lubrication compositions for various forging problems utilizing the concepts of the forging window for the glass component and, formulating a vitreous phase including an abrasive material as a material for improving the relative moveability of the surface of the workpiece with respect to the surface of the die.

In use, the precoat composition suitably selected for the temperature of forging is applied to the workpiece as one or more coats, e.g., 5 applications. A coating thickness prior to firing of from about 2 to 30 mils is satisfactory. The wet workpiece is then dried in an oven at a temperature sufficient to remove solvent and/or diluent and set the resinous component. The resin used may be one which cures by heat, e.g., a B-stage phenol-formaldehyde resin. The oven temperature is in the range of from 150° F. to 250° F. preferably 180° F. to 230° F. the latter being especially suitable for a polymethylmethacrylate resin binder. This provides a precoated workpiece in which the "green strength" of the precoated workpiece is sufficient to allow handling with tongs, for example without penetration of the coating.

The workpiece is then heated in a furnace to a temperature of from 1000° F. to 1800° F. for from 5 to 60 minutes depending on the size to decompose the organic moiety of the coating and leave the glass/abrasive composition on the surface. A polymethylmethacrylate (Plexiglas) binder, for example, leaves no char residue on thermal decomposition. This process preheats the coated workpiece to near forging temperature and minimizes the time required to achieve forging temperature in the heated dies. The thickness of the coating will often increase by an amount ranging up to about 4 times its original thickness. The workpiece is then inserted in the die and pressure from a hydraulic source applied to shape, or size, the workpiece until shaping or sizing is complete and the workpiece is stress relieved.

Thereafter, the pressure is released and the part released from the die. It may then be cooled at a controlled rate, or spontaneously air cooled. The part is then cleaned by sand blasting, immersion in molten salt, or other chemical means. The cycle may then be repeated.

It should be pointed out that some of the inorganic abrasive materials, particularly the metal oxide type, tend to be soluble to some extent at least in the vitreous component on prolonged contact therewith or at elevated temperatures, e.g. above 1800° F. This is not usually a problem because the forging operation is conducted at a low enough temperature and/or is complete before substantial dissolution of the abrasive moiety. With the refractory metal carbides, this is not a problem.

In general, the lubricant-separation compositions of the present invention at the time of forging are dispersions of finely divided abrasive material in a fused vitreous medium. Broadly, the weight percent of finely divided abrasive material in the vitreous material under forging conditions is in the range of from about 1% to about 15%. For most purposes, from 5% to 8% will be found satisfactory for good lubrication and good separation or release from the mold.

The precoat compositions contain a resinous binder and a solvent and/or diluent in which the vitreous ingredients and the abrasive material are well dispersed and suspended. The vitreous ingredients are also finely divided to aid in forming a suspension of sufficient stability to allow application. For example, an agitated immersion bath may be used for precoating the workpieces; an agitated supply may be used for spray application, etc. With brush application, the viscosity of the dispersion in the resin may be adjusted with solvent and/or diluent as desired for stability and ease of application.

It is convenient to illustrate lubricant-separation compositions of the invention with reference to compositions which have been found especially useful in the isothermal forging of a beta titanium alloy in nickel-chromium superalloy dies. A specific example of a Ti—10 V—2 Fe—3 Al titanium alloy analyzes 0.05 max C; 0.05 max N; 1.8–2.2 Fe; 2.6–3.4 Al; 9.0–11.0 V; 0.16 max O; 0.015 max H; bal. Ti. A typical nickel-base superalloy die material analyzes 0.18 C; 10.0 Cr; 15.0 Co.; 3.0 Mo; 4.7 Ti; 5.5 Al; 0.014 B; 0.06 Zr; 1.0 V; bal. Ni, and has a melting point in the range of 2305°–2435° F. A typical iron base superalloy die material analyzes 0.05 C; 1.35 Mn; 0.50 Si; 15.0 Cr; 26.0 Ni; 1.3 Mo; 2.0 Ti; 0.2 Al; 0.015 B; balance Fe, and has a melting point of 2500°–2550° F.

TABLE IV

FORMULATION OF LUBRICATION-SEPARATION COMPOUNDS FOR TITANIUM ALLOY (BETA) IN SUPERALLOY DIES

| | Vitreous Phase | | Particulate | | Binder | | Diluent | |
|---|---|---|---|---|---|---|---|---|
| Example Coating | Type | Amount (Grams) | Type | Amount (Grams) | Type | Amount (Grams) | Type | Amount (Grams) |
| 1 | EX V-11 | 50 | SiC | 2.5 | ACR* | 6.7 | ISO** | 15.0 |
| 2 | " | " | $TiSe_2$ | " | " | " | " | " |
| 3 | " | " | $TiO_2$ | 4.0 | " | 6.4 | XYL*** | 10.0 |
| 4 | " | " | TiN | 2.5 | " | 6.0 | ISO | 7.5 |
| 5 | " | " | TaC | " | " | " | " | " |
| 6 | " | " | $Cr_3C_2$ | " | " | " | " | " |
| 7 | " | " | WC | " | " | " | " | " |
| 8 | " | " | $Al_2O_3$ | " | " | " | " | " |
| 9 | " | " | $CaF_2$ | " | " | 5.8 | " | 5.0 |
| 10 | " | " | — | " | " | 6.0 | ISO | 10.0 |
| 11 | EX V-12 | 50 | SiC | 2.5 | " | 6.2 | ISO | 10.0 |
| 12 | " | " | $TiSe_2$ | " | " | " | " | " |
| 13 | " | " | TiN | " | " | 5.8 | " | " |
| 14 | " | " | TaC | " | " | " | " | " |
| 15 | " | " | $Cr_3C_2$ | " | " | " | " | " |
| 16 | " | " | WC | " | " | " | " | " |
| 17 | " | " | $Al_2O_3$ | " | " | " | " | " |
| 18 | " | " | CeO | 4.0 | " | 5.0 | " | 5.0 |
| 19 | " | " | TiC | 4.0 | " | 5.0 | " | 5.0 |

*ACR = polymethylmethacrylate
**Isopropyl alcohol
***Xylene

Examples 14 and 15 above showed the best performance in terms of compatibility with the die, stability and accumulation, at an isothermal forging temperature in the iron base superalloy dies at 1350° F. Examples 5 and 6 above showed the best performance at an isothermal forging temperature of 1500° F. in the above described nickel-base superalloy dies. Example 9 caused a very aggressive attack on the dies under isothermal forging conditions. Example 10 was ineffective as a separation composition as it contained no abrasive component.

We claim:

1. A method of isothermally forging a preheated metallic workpiece and a preheated die at a predetermined temperature above 500° F. and below about 1800° F. which comprises the step of interposing between the die and the workpiece a film of a forging lubricant comprising an amount in excess of 50% by weight of a fused vitreous composition having dispersed therein from 1% to 15% by weight of at least one finely divided infusible inorganic abrasive component having a melting point above the forging temperature and a hardness at room temperature of from 5.5 to 10 Mohs, said inorganic abrasive component having a particle size in the range of from 1 to 75 microns, and being nonreactive with the metal of the workpiece and the metal of the die at the forging temperature, and said inorganic abrasive component remaining as a separate dispersed phase in the fused vitreous composition.

2. A method of isothermally forging a preheated metallic workpiece and a preheated die at a predetermined temperature above 500° F. which comprises the step of interposing between the die and the workpiece a film of a forging lubricant comprising an amount in excess of 50% by weight of a fused vitreous composition having dispersed therein from 1% to 15% by weight of at least one finely divided inorganic abrasive component having a melting point above the forging temperature and a hardness at room temperature of from 5.5 to 10 Mohs, said norganic abrasive component having a particle size in the range of from 1 to 75 microns, and being nonreactive with the metal of the workpiece and the metal of the die at the forging temperature.

3. The method as defined in claim 1 wherein the metallic workpiece is titanium or a titanium alloy and the die is a nickel and chromium containing superalloy.

4. A method as defined in claim 1 wherein the amount in excess of 50% by weight is from 85% to 99% of a fused vitreous composition.

5. A method as defined in claim 1 wherein the vitreous composition is a mixture of metal oxides one of which is silicon dioxide.

6. A method as defined in claim 5 wherein the silicon dioxide is from about 20% to 81% of the vitreous phase.

7. A method as defined in claim 6 wherein the vitreous phase also contains boron trioxide in an amount of from about 4.9% to about 60% by weight.

8. A method as defined in claim 7 wherein the vitreous phase also contains an alkali metal oxide in an amount of from about 0.7% to about 15.9% by weight.

9. A method as defined in claim 5 wherein the vitreous phase also contains lead oxide (PbO) in an amount ranging from about 3% to about 80% by weight.

10. A method as defined in claim 7 wherein the vitreous phase contains no more than about 5% of an alkali metal oxide.

11. A method as defined in claim 10 wherein the vitreous phase contains no more than about 2% of an alkali metal oxide.

12. A method as defined in claim 11 wherein the vitreous phase is substantially free of alkali metal oxide and the forging temperature is approximately 1800° F.

13. A method as defined in claim 2 wherein the finely divided abrasive material is a refractory metal carbide.

14. A method as defined in claim 1 wherein the inorganic abrasive component is a refractory metal carbide.

15. A method of isothermally forging a preheated titanium alloy workpiece in a preheated nickel-chromium containing super alloy die at a temperature between 1300° F. and 1800° F. which comprises the step of interposing between the die and the workpiece a film of a forging lubricant comprising (a) about 95% by weight of a borosilicate fused vitreous phase including up to 7.0% of an alkali metal oxide and 2.0% cobalt oxide; and (b) an infusible inorganic abrasive component comprising about 5% by weight of a refractory metal carbide having an average particle size of from 1–8 microns dispersed in said vitreous phase and remaining as a separate dispersed phase in the fused vitreous phase.

16. A method of isothermally forging a preheated titanium alloy workpiece and a preheated nickel-chromium containing super alloy die at a temperature between 1300° F. and 1800° F. which comprises the step of interposing between the die and the workpiece a film of a forging lubricant comprising a borosilicate vitreous phase including up to 7.0% of an alkali metal oxide and 2.0% cobalt oxide; the amount of about 95% and about 5% by weight of a refractory metal carbide having an average particle size of from 1–8 microns.

* * * * *

UNITED STATES PATENT AND TRADEMARK OFFICE

CERTIFICATE OF CORRECTION

PATENT NO. : 4,183,236

DATED : January 15, 1980

INVENTOR(S) : William D. Spiegelberg et al.

It is certified that error appears in the above-identified patent and that said Letters Patent are hereby corrected as shown below:

Column 12, line 13, change the numeral "2" to the numeral --1--.

Please add the following claim:

17. A method as defined in claim 15 wherein the refractory metal carbide is chromium carbide.

On the title page, after the Abstract "16 Claims" should read -- 17 Claims --.

Signed and Sealed this

Fourteenth Day of April 1981

[SEAL]

Attest:

RENE D. TEGTMEYER

Attesting Officer

Acting Commissioner of Patents and Trademarks